US008482479B2

(12) United States Patent
Das

(10) Patent No.: US 8,482,479 B2
(45) Date of Patent: Jul. 9, 2013

(54) AZIMUTH-INDEPENDENT IMPEDANCE-MATCHED ELECTRONIC BEAM SCANNING FROM A LARGE ANTENNA ARRAY INCLUDING ISOTROPIC ANTENNA ELEMENTS

(75) Inventor: Nirod K. Das, Ledgewood, NJ (US)

(73) Assignee: Polytechnic Institute of New York University, Brooklyn, NY (US)

( * ) Notice: Subject to any disclaimer, the term of this patent is extended or adjusted under 35 U.S.C. 154(b) by 486 days.

(21) Appl. No.: 12/649,032

(22) Filed: Dec. 29, 2009

(65) Prior Publication Data

US 2010/0220009 A1 Sep. 2, 2010

Related U.S. Application Data

(60) Provisional application No. 61/142,297, filed on Jan. 2, 2009.

(51) Int. Cl.
*H01Q 15/02* (2006.01)
*H01Q 19/06* (2006.01)

(52) U.S. Cl.
USPC ..... 343/909; 343/754

(58) Field of Classification Search
USPC ..... 343/757, 793, 810, 813, 909, 753, 343/754
See application file for complete search history.

(56) References Cited

U.S. PATENT DOCUMENTS

| | | | | |
|---|---|---|---|---|
| 6,583,760 | B2 * | 6/2003 | Martek et al. | 342/373 |
| 7,889,127 | B2 * | 2/2011 | Sajuyigbe et al. | 342/372 |
| 2008/0129626 | A1 * | 6/2008 | Wu et al. | 343/767 |
| 2010/0201579 | A1 | 8/2010 | Das | |
| 2010/0201592 | A1 | 8/2010 | Das | |

OTHER PUBLICATIONS

Wang, Wei-Jen, "Multilayer Printed Antennas with Biaxial Anisotropic Dielectric Substrates: General Analysis and Case Studies" Dissertation, Submitted in Partial Fulfillment of the Requirements for the Degree of Doctor of Philosophy (Electrical Engineering), Polytechnic University (Jan. 2002).

* cited by examiner

*Primary Examiner* — Robert Karacsony
(74) *Attorney, Agent, or Firm* — Straub & Pokotylo; John C. Pokotylo

(57) ABSTRACT

A large periodic array of ideally isotropic antenna elements permits electronic beam scanning and has a performance of power coupling from signal sources at the antenna inputs which is independent of the azimuth (Φ) scanning direction, dependent only on one spatial variable (elevation angle, θ) of scanning Such performance from an antenna array normally can not be achieved using conventional designs. Such an antenna array may be used in communications and radars.

15 Claims, 8 Drawing Sheets

200

400

700

800

AZIMUTH-INDEPENDENT IMPEDANCE-MATCHED ELECTRONIC BEAM SCANNING FROM A LARGE ANTENNA ARRAY INCLUDING ISOTROPIC ANTENNA ELEMENTS

§0. RELATED APPLICATIONS

Benefit is claimed, under 35 U.S.C. §119(e)(1), to the filing date of U.S. provisional patent application Ser. No. 61/142,297 (referred to as "the '297 provisional"), titled "NEW ANTENNA APPARATUS EMPLOYING ARTIFICIAL DIELECTRIC SUBSTRATES WITH VERTICAL WIRE STRUCTURES FOR ACHIEVING AN IDEALLY-ISOTROPIC RADIATION/RECEPTION FROM A SINGLE ANTENNA ELEMENT, AND FOR AZIMUTH(ϕ)-INDEPENDENT IMPEDANCE-MATCHED ELECTRONIC BEAM SCANNING FROM A LARGE ANTENNA ARRAY," filed on Jan. 2, 2009 and listing Nirod DAS as the inventor, for any inventions disclosed in the manner provided by 35 U.S.C. §112, ¶ 1. The '297 provisional application is expressly incorporated herein by reference. The scope of the present invention is not limited to any requirements of the specific embodiments described in the '297 provisional application.

§1. BACKGROUND OF THE INVENTION

§1.1 Field of the Invention

The present invention concerns antennas. In particular, the present invention concerns providing an improved antenna array with simplified impedance matching.

§1.2 Background Information

Normally, the scanning performance of a large planar antenna array depends strongly on both the azimuth (Φ) and elevation (θ) directions of scanning. Unfortunately, this makes it practically difficult to "match" its electronic circuits in order to perform in a desired manner for scanning in all directions in Φ and θ. This is because there will be too many directions, Φ and θ, in a 3D space, for it to be practical to implement complex circuit optimization.

Therefore, it would be useful to simplify the optimization of antenna arrays.

§2. SUMMARY OF THE INVENTION

Embodiments consistent with the present invention can be used to meet the foregoing needs by providing a large periodic array of ideally isotropic antenna elements to permit electronic beam scanning (also referred to as "steering") while permitting performance of power coupling from signal sources at the antenna inputs to be optimized in a manner which is independent of the azimuth (Φ) scanning direction (dependent only on one spatial variable (elevation angle, θ) of scanning) Such embodiments might do so by providing a system including (a) an array of dipole antenna elements, (b) a control circuit for steering the dipole antenna elements over a first range of elevation angles and a second range of azimuth angles, (c) at least one wired substrate arranged adjacent to the array of dipole antenna elements such that each of the dipole antenna elements has a substantially isotropic radiation characteristic, and (d) for each of the dipole antenna elements of the array, a power coupling module adapted to match a resistance of the dipole antenna element to a source resistance of a signal source, as a function of a current elevation angle, but independent of a current azimuth angle.

Exemplary methods consistent with the present invention may determine variable matching circuit parameters for such an improved antenna element of an antenna array, by, for each of a plurality of ranges of elevation angles, (a) providing a series reactance between the antenna array element and its signal source, and (b) matching a remaining resistance, at the elevation angle range, to the source resistance of the signal source, wherein the remaining resistance is independent of an azimuth angle.

§3. BRIEF DESCRIPTION OF THE DRAWINGS

§4. DETAILED DESCRIPTION

The present invention may involve improved antenna arrays with simplified impedance matching. The following description is presented to enable one skilled in the art to make and use the invention, and is provided in the context of particular applications and their requirements. Thus, the following description of embodiments consistent with the present invention provides illustration and description, but is not intended to be exhaustive or to limit the present invention to the precise form disclosed. Various modifications to the disclosed embodiments will be apparent to those skilled in the art, and the general principles set forth below may be applied to other embodiments and applications. For example, although a series of acts may be described with reference to a flow diagram, the order of acts may differ in other implementations when the performance of one act is not dependent on the completion of another act. Further, non-dependent acts may be performed in parallel. Also, as used herein, the article "a" is intended to include one or more items. Where only one item is intended, the term "one" or similar language is used. In the following, "information" may refer to the actual information, or a pointer to, identifier of, or location of such information. No element, act or instruction used in the description should be construed as critical or essential to the present invention unless explicitly described as such. Thus, the present invention is not intended to be limited to the embodiments shown and the inventor regards his invention to include any patentable subject matter described.

Figure 1:
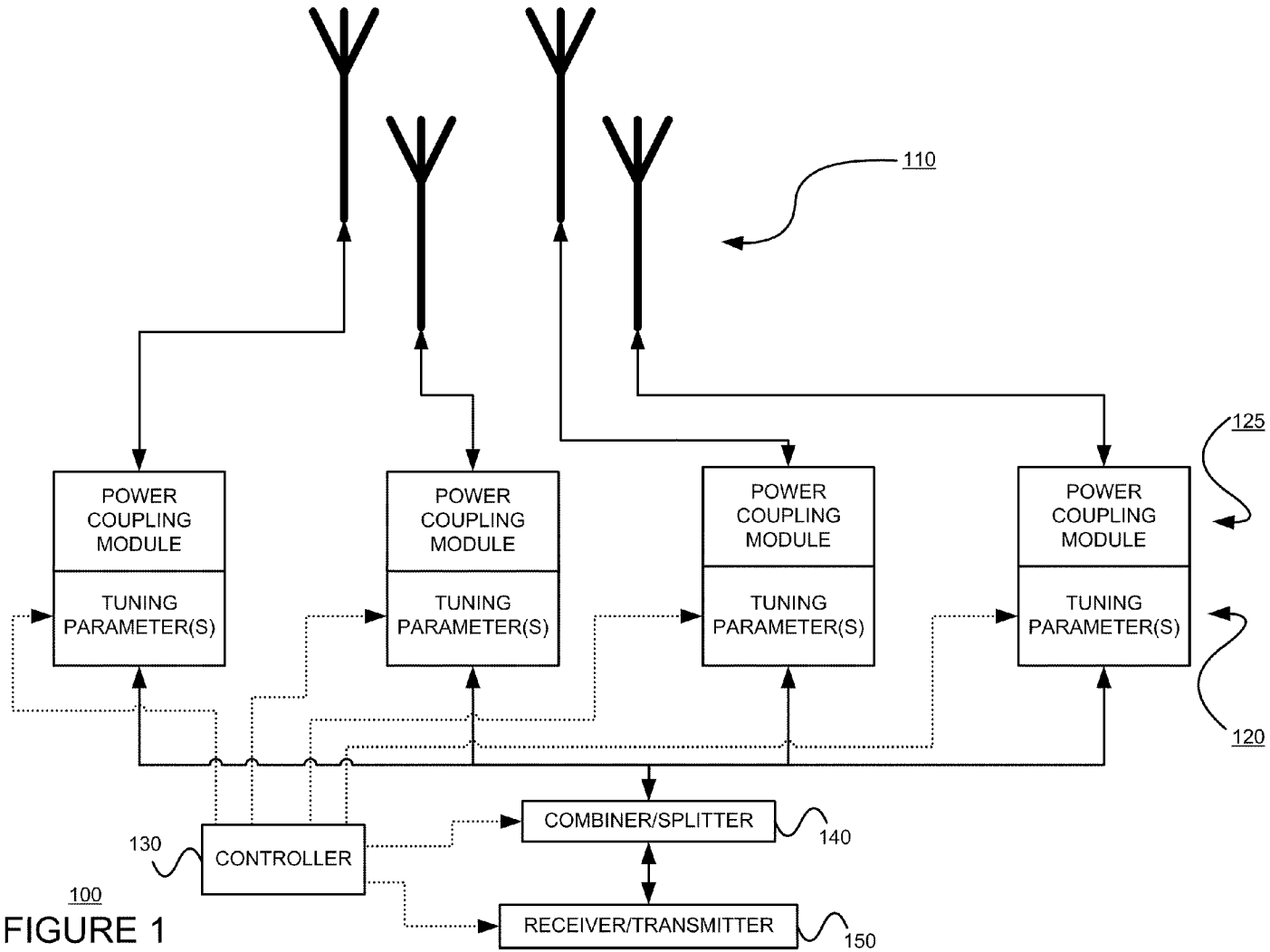
FIG. 1 illustrates elements of a system in which an antenna array consistent with the present invention may be used.

§4.1 Exemplary System in Which an Antenna Array Consistent with the Present Invention may be Used FIG. 1 illustrates elements of a system 100 in which an antenna array consistent with the present invention may be used. The system 100 may include an array of antennas 110, each of the antennas 110 being associated with tuning parameter(s) (e.g., a time delay or phase shift) 120 and a power coupling (e.g., matching) module 125. A controller 130 may be used to set and/or control the tuning parameter(s) 120 and may control a combiner and/or splitter 140, and a receiver and/or transmitter 150. For example, the controller might provide radiation steering control, parameter tuning, etc. Signals received by the antennas 110 may be coupled with a combiner 140, which provides a combined signal to the receiver 150. A transmitter may provide a signal to the splitter 140, which sends separate signals to the antennas 110.

As discussed above, typically, the scanning performance of a large planar antenna array 110 depends strongly on both the azimuth (Φ) and elevation (θ) directions of scanning However, this makes it practically difficult to "match" its electronic circuits (in power coupling modules 125) in order to perform in a desired manner for scanning in all directions in Φ and θ. In embodiments consistent with the present invention, improved dipole antennas, having an ideally isotropic radiation characteristic, are used as the antennas to simplify the task of "matching" their circuits (in power coupling modules 125) for scanning in all directions.

§4.2 Exemplary Improved Dipole Antennas

Figure 3:
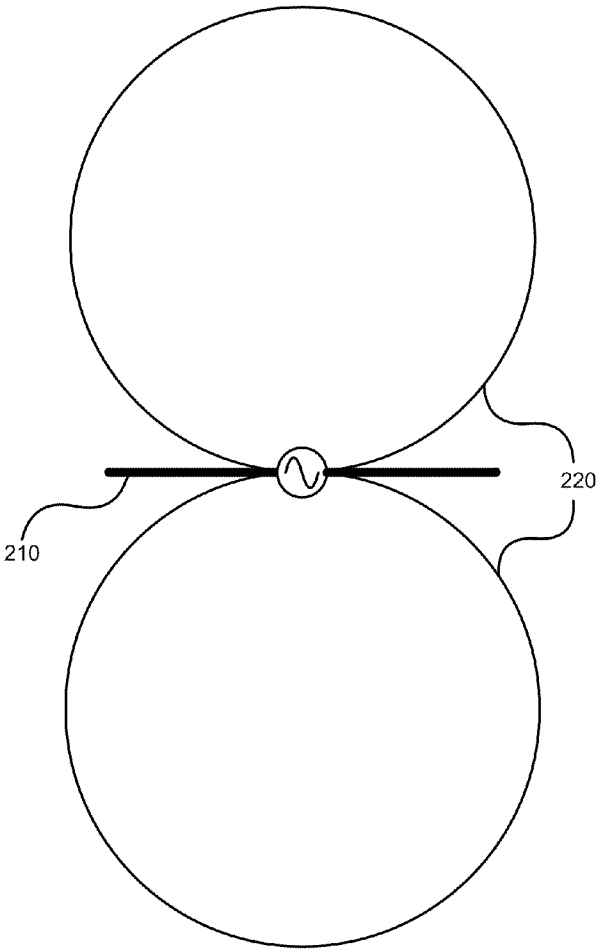
FIGS. 2 and 3 illustrate radiation of a conventional dipole antenna.
Figure 2:
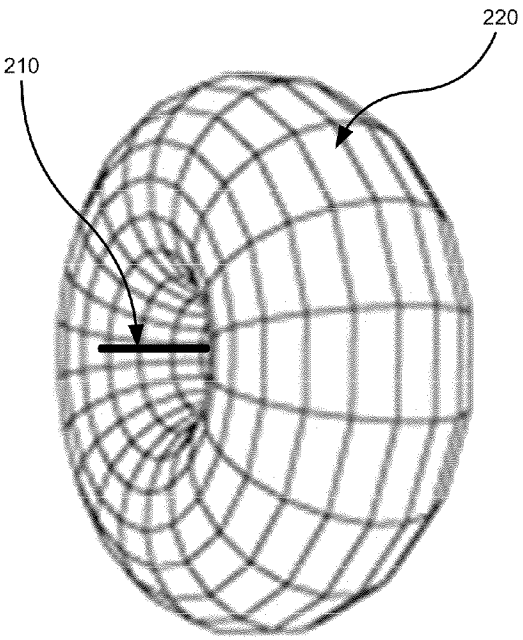

Referring to FIGS. 2 and 3, as is know in the art, dipole antennas 210 typically have a toroidal or flattened toroidal radiation characteristic 220. Thus, the radiation power is highly dependent upon the orientation of the dipole antenna 220.

Figure 4:
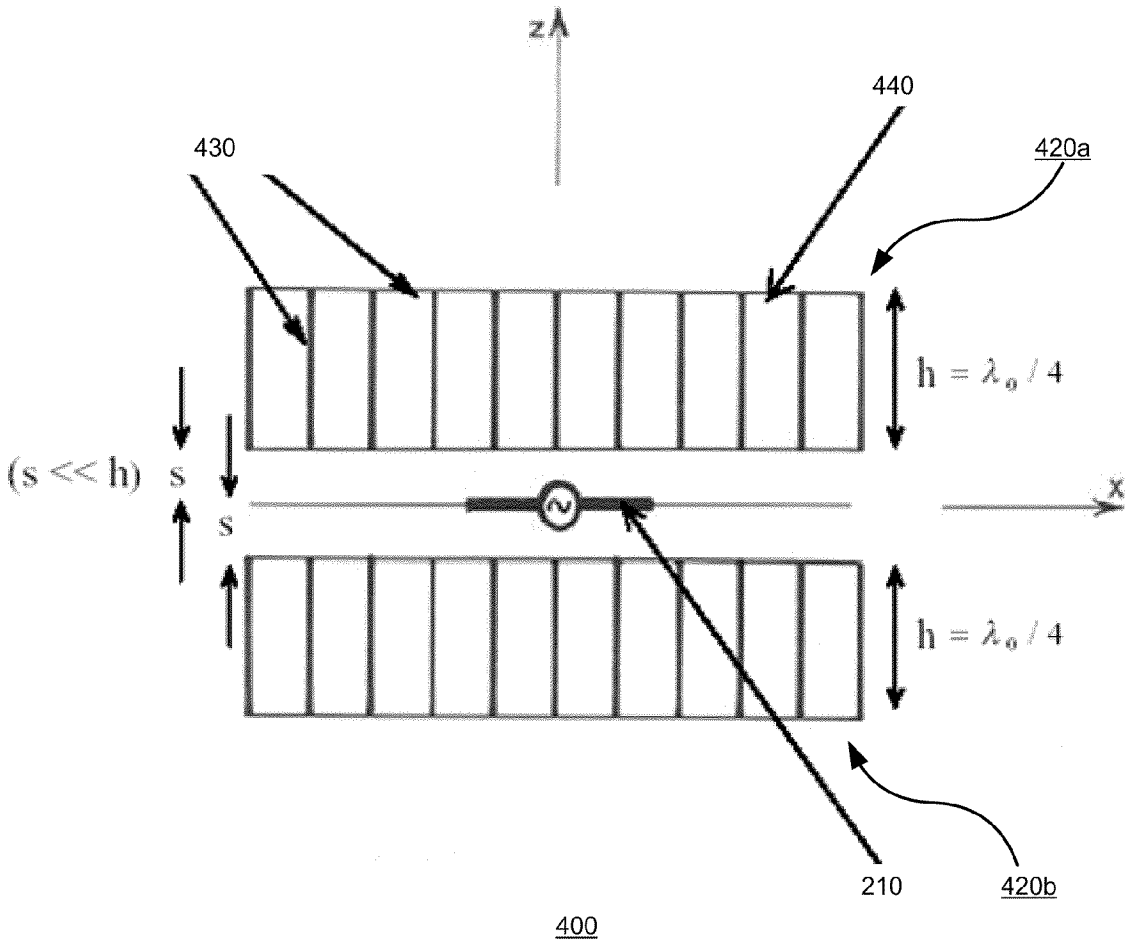
FIG. 4 is a cross-sectional side view of an improved dipole antenna consistent with the present invention.
Figure 5:
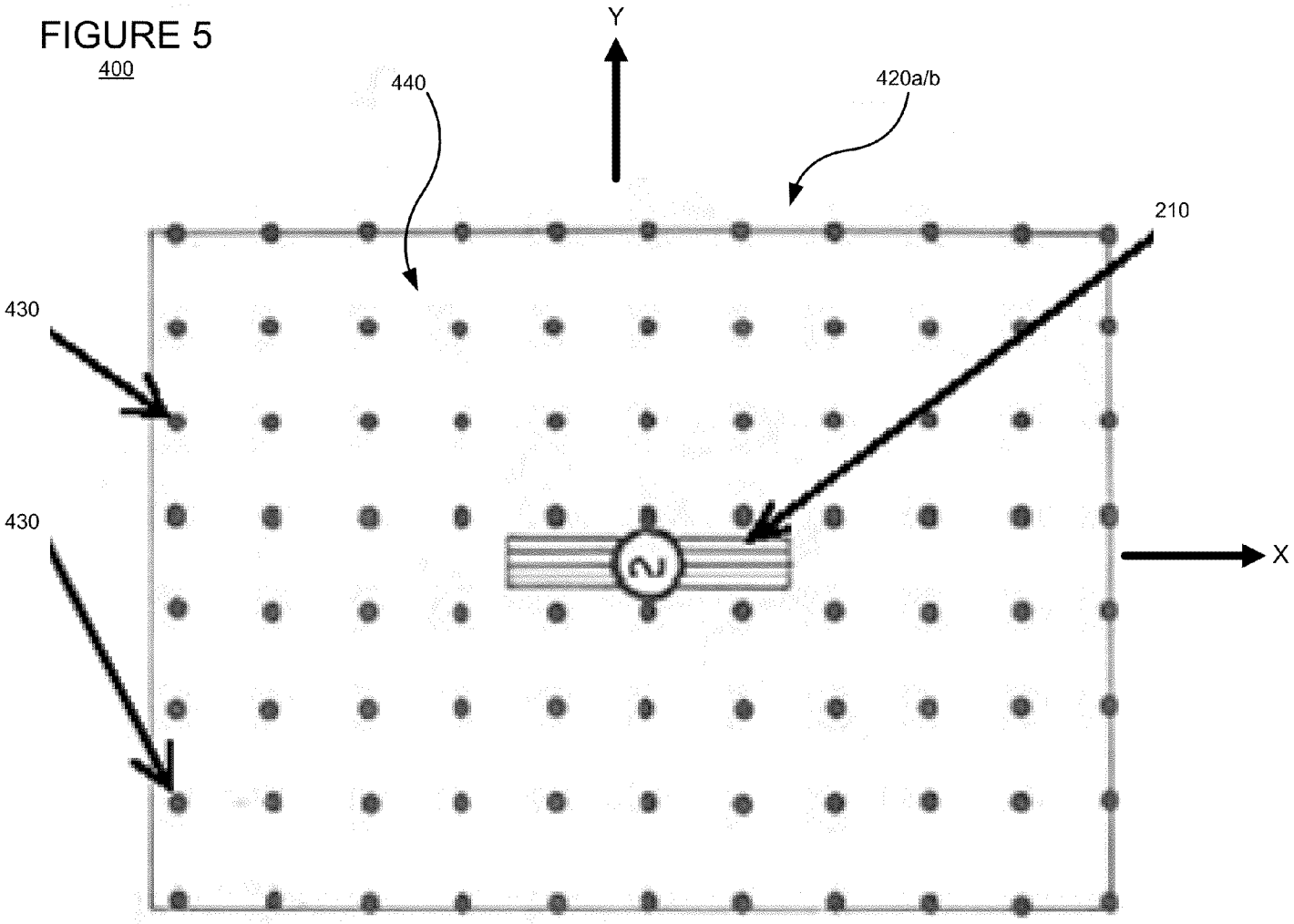
FIG. 5 is a plan view of an improved dipole antenna consistent with the present invention.

FIG. 4 is a cross-sectional side view of an improved dipole antenna, which may be used in an antenna array consistent with the present invention, and which has an ideally isotropic radiation characteristic. FIG. 5 is a plan view of the improved dipole antenna of FIG. 4. Exemplary embodiments consistent with the dipole antenna are described in the '297 provisional and in the thesis "Multilayer Printed Antennas with Biaxial Anisotropic Dielectric Substrates: General Analysis and Case Studies," by Wei-Jen Wang, Electrical Engineering Department, Polytechnic University (January 2002) (incorporated herein by reference).

The improved dipole antenna of FIGS. 4 and 5 includes a dipole antenna element 210 arranged between substrate elements 420*a* and 420*b* (each also referred to as a "substrate" or a "wired substrate"). The substrate elements 420*a/b* are made of a low dielectric constant material (such as polymer-based foams) 440, inside which metal wires 430 are reinforced in normal orientation. The reinforcing metal wires 430 should be placed as densely as possible. In the ideal case, the wiring density would reach infinity, with the diameter of the wires approaching zero. Naturally, practical manufacturing of such wire reinforcement would deviate from this ideal configuration. Although such deviation in practical manufacturing would, in principle, produce some deviation in performance, such performance deviations are expected to be negligible when the wiring separations and diameters are much smaller than the wavelength (λ) at a given operating frequency of the antenna. In other words, for a desired performance at a given frequency of application, one should pack the wires with separations much smaller than the operating wavelength (λ).

In FIG. 4, the dipole antenna element 210 is shown with a small spacing "s" from the substrate elements 420*a/b* above and below it. Ideally, the spacing "s" needs to be zero to achieve ideal performance. However, if the spacing "s" were zero, the near field of the antenna element 210 would directly interact with the substrate elements 420*a/b*. In addition to influencing the radiation characteristic of the antenna, as expected and desired, the substrate elements 420*a/b* would also strongly influence the reactance, resonance condition and bandwidth of the antenna. Accordingly, the design of the antenna element 210 should consider the near-field effects of the substrate elements 420*a/b*. However, it might be preferable if an antenna element already designed based on a conventional surrounding medium, could simply be "covered" by the new substrate elements 420*a/b*, and the new design would function with the new desired features. This may be possible by having a small, non-zero spacing "s" between the antenna 210 and the substrate elements 420*a/b* above and below the antenna 210. The spacing "s" should be designed such that both (1) it is sufficiently small such that there would be only minimal deviation from the desired radiation performance of the improved antenna, and (2) it is sufficiently larger than the thin layer of the strong reactive fields, present in close proximity of the antenna, such that the reactive performance (resonance, bandwidth, etc.) would remain essentially unchanged. This would allow a designer to simply cover a conventional (e.g., planar) dipole antenna element, on its two sides, with the new substrate elements 420*a/b* to produce the desirable new radiation features with only minimal design adjustments.

Figure 6:
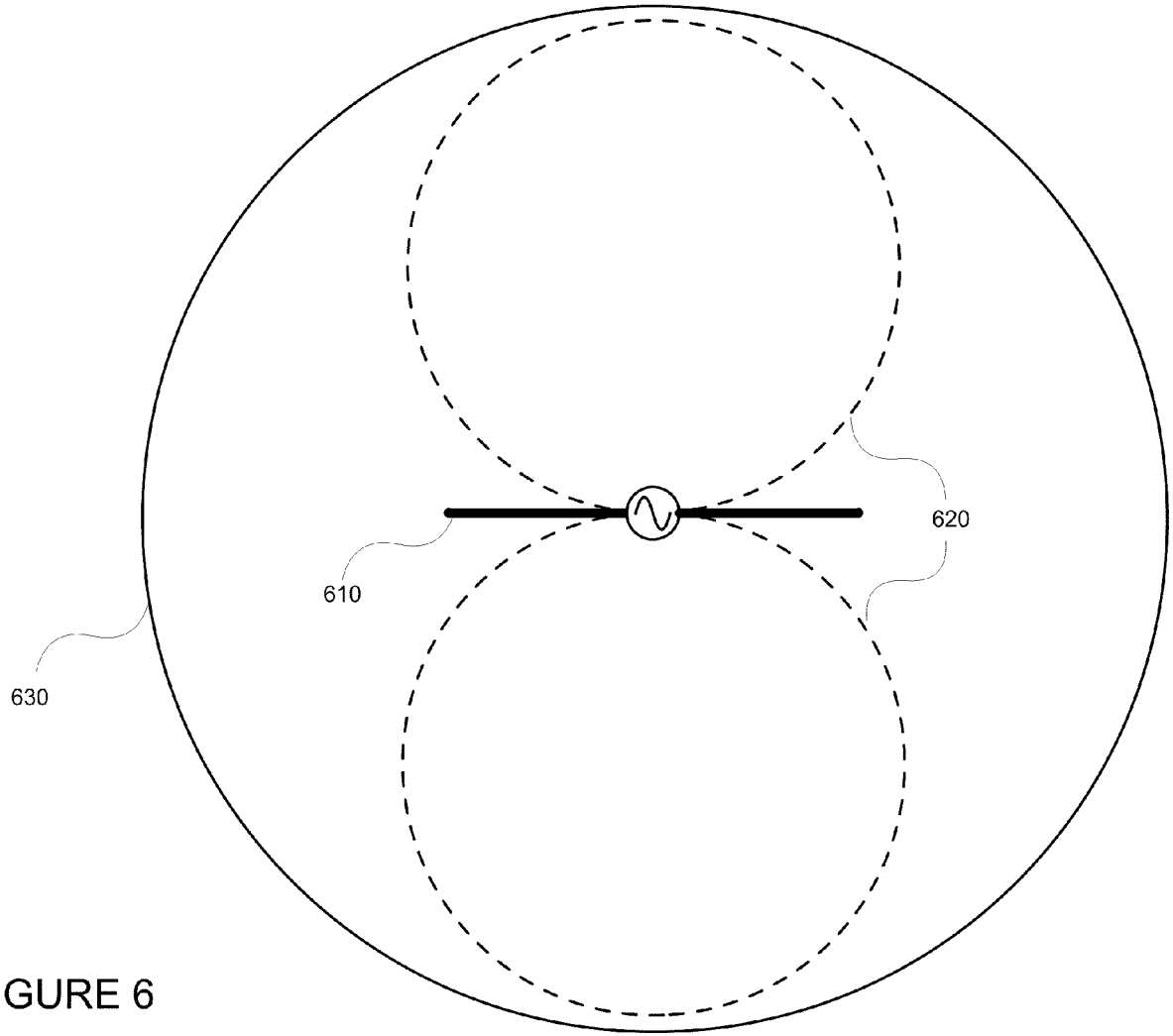
FIG. 6 illustrates a radiation of an improved dipole antenna which may be used in an antenna array consistent with the present invention.

The improved dipole antenna of FIGS. 4 and 5 would basically produce an isotropic power pattern along all directions in a 3-D full spherical space, both toward above and below the antenna substrate. Thus, referring to FIG. 6, rather than a torus shaped radiation pattern (cross section 620), the dipole antenna 610, provided with the substrate elements (not shown), would ideally generate a spherical pattern (cross section 630). Similarly, when used in an antenna array (as described below), it would facilitate scanning of the antenna array, which would simultaneously produce two beams—one in the upper hemi-spherical space and another symmetric beam in the lower hemi-spherical space.

If it is desired to have an isotropic radiation pattern or antenna scanning only in the upper or lower hemi-spherical space, the basic design may be modified as follows. Referring to FIG. 4, an equivalent magnetic conductor (not shown) may be placed immediately below the planar dipole element 210 (replacing substrate element 420*b*). The equivalent magnetic conductor would essentially act as a reflector which would reflect any radiation directed in the lower half space toward the upper half space, as desired. Although an ideal magnetic conductor does not exist naturally, one may artificially synthesize an equivalent magnetic conductor (at least approximately) for such use using techniques known to those skilled in the art such as experts and researchers.

§4.2.1 Technical Concept of the Improved Antenna Element

§4.2.1.1 The Wired Substrate

A wired substrate, where the metal wires are aligned in the normal (to substrate interface) direction, behaves as a uniaxial conducting medium. The medium short-circuits the normal (z) component of the electric field, while keeping the transverse components (x and y) of the electric field unaffected. The radiation from a planar dipole antenna may be completely decomposed into two parts: TE-to-z (transverse electric to z) radiation; and TM-to-z (transverse magnetic to z) radiation. Each is separately considered below.

The TE-to-z radiation has electric fields transverse or normal to z, and is therefore unaffected by the substrate wiring in the z direction. The TM-to-z radiation has its magnetic fields transverse to the z direction, while the electric field in general has a component along z. Therefore, the TM-to-z radiation is strongly affected by the presence of the short-circuiting, z-directed wires. In this case, the metal wiring may be viewed as closely spaced transmission lines filled with a low-dielectric constant medium (which may be considered effectively a free space medium with dielectric permittivity $\epsilon_0$.) The propagation constant $\beta_z$ along the z direction in this case is equal to the free-space wave number $k_0$, which is independent of the direction of radiation. The corresponding equivalent wave impedance $Z_{substrate,TM}$ of the substrate medium can be shown to be equal to the free-space wave impedance $\eta_0$, which is also independent of the direction of radiation.

$$Z_{substrate,TM}=\beta_z/(\omega\epsilon_0)=k_0)=\eta_0 \quad (1)$$

The above relations for the propagation constant and equivalent impedance may also be validated using an alternate theoretical treatment. This is possible by viewing the wired medium as an anisotropic material where the conductivity is infinity along the z-direction but zero along x and y, whereas the dielectric property is isotropic in all directions with its relative dielectric constant equal to (or close to) unity.

§4.2.1.2 Antenna in the Presence of the Wired Substrate

The total radiation from the dipole element in the presence of the wired substrate medium is now described using TE and TM wave decomposition, and using equivalent impedance modeling for each case. (This is a standard technique used for modeling planar antennas.) Regarding the TM-to-z radiation from the dipole in the presence of the wiring substrate medium, let the equivalent input impedance in this case be equal to $Z_{in,TM}$. This TM input impedance $Z_{in,TM}$ can be shown to be equal to $Z_{air,TE}$, which is the impedance seen by a TE-to-z wave in an air or a free-space medium, without any covering substrate. To this end, the wiring substrate medium may be seen to operate as a quarter-wave transformer, which transforms the TM-to-z impedance $Z_{air,TM}$ of the free-space or air medium at the top layer to the TE-to-z impedance $Z_{air,TE}$, as derived below. This useful transformation is possible because the TM-to-z impedance $Z_{substrate,TM}$ of the wiring substrate medium is equal to the wave impedance $\eta_0$ of the free space, independent of the propagation angle θ, as per equation (1).

$$Z_{air,TM} = \eta_0\cos\theta,\ Z_{subtrate,TM} = \eta_0 \quad (2a)$$

$$Z_{in,TM} = \frac{(Z_{substrate,TM})^2}{Z_{air,TM}} = \frac{\eta_0}{\cos\theta} = Z_{air,TE} \quad (2b)$$

As derived above, the TM-to-z wave in the presence of the wiring medium is equivalently "seen" by the dipole antenna as if it is a TE-to-z wave in the free space. Recall that the TE-to-z wave in the presence of the wiring medium is also seen by the dipole antenna as if it is TE-to-z wave in the free space. Therefore, the dipole sees the total radiation (TE plus TM waves) in the presence of the wired medium as if it sees the free space for a purely TE-to-z radiation. In other words, the total input impedance $Z_{in}$ seen by the dipole, in the presence of the wired substrate, is equal to the TE-to-z impedance of the air or free space medium, without any wired substrate.

$$Z_{in} = Z_{air,TE} = \frac{\eta_0}{\cos\theta} \quad (3)$$

The radiation pattern of the dipole source is known to be proportional to the product of three factors: (1) the total equivalent impedance $Z_{in}$ seen by the dipole source; (2) the source transform as a function of the wave numbers on the transverse plane (or equivalently the radiation angles θ and ϕ); and (3) an additional cos θ factor. The cos θ factor relates the density of the power flow in the normal direction, which is characterized by the transverse equivalent modeling, to that in a particular radiation direction. If the dipole element is electrically small, the source distribution may be approximated as a delta function, whose transform is a constant, independent of the transform parameters or radiation directions. In this case, as per the above principle, the power radiation pattern would be proportional to cos θ $Z_{in}$, which is independent of both θ and ϕ angles.

$$\cos\theta Z_{in} = \cos\theta\frac{\eta_0}{\cos\theta} = \eta_0 \quad (4)$$

§4.3 Exemplary Antenna Array Including Improved Dipole Antennas

Figure 7:
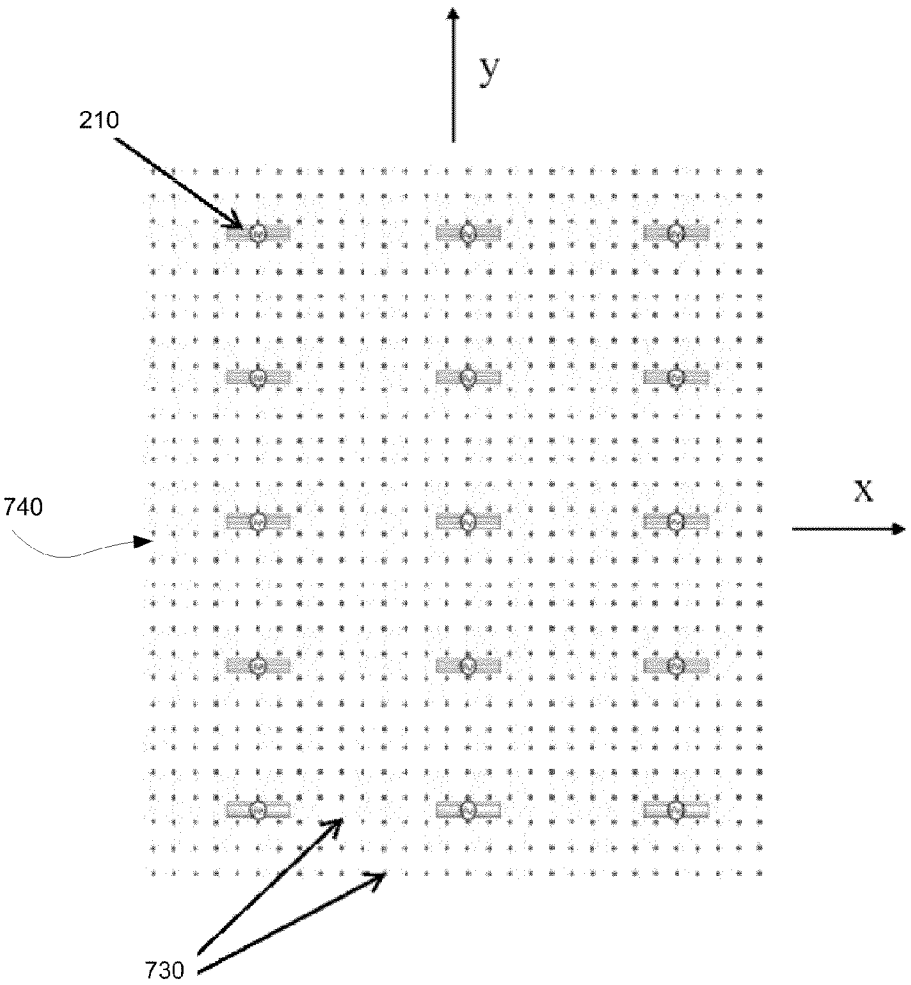
FIG. 7 is a plan view of an array of improved dipole antennas consistent with the present invention.

FIG. 7 is a plan view of an array of improved dipole antennas consistent with the present invention. More specifically, FIG. 7 is a plan view of an arrangement of an array of strip dipole antenna elements 210, printed on the XY plane, between two substrate elements (with the top substrate element removed). This array geometry is useful for antenna beam steering. The array can be designed advantageously with a scanning impedance which is independent of the scanning direction in any azimuthal plane. Further, with proper impedance matching, the array can be scanned efficiently over a range of solid angles.

The input impedance seen at each antenna element 210 may also be modeled using the transverse impedance technique used above to characterize an isolated element. The periodic array may be considered as a superposition of Floquet modes. The equivalent impedance $Z_{in}=Z_{air,TE}=\eta_0/\cos\theta$ of equation (3) would be seen by the dominant Floquet mode of the array. This impedance is independent of the ϕ angle of antenna scanning. The impedance at the input of each element of the array is mostly determined by the impedance seen by the dominant Floquet mode. Therefore, the impedance at the input of each element of the array is independent of the scan angle ϕ. Accordingly, the array would be able to couple source power to each element equally well in all values of scan angle ϕ.

However, the impedance still depends on the θ value of the scan direction. In other words, the antenna array's scanning performance is essentially a function of one angle variable—θ. Thus, if the array is designed for scanning along one particular ϕ, the design would work equally well for all ϕ values.

Practical techniques do exist to optimally match antenna arrays for scanning in one given ϕ plane (or possibly in only a few selected ϕ planes). This is possible by using matching circuits that may be dynamically tuned or switched to match the varying array impedance to a given source, as the array is scanned in different elevation angle θ. Other advanced techniques may also be employed to this end, by using a matching cover layer, made of a regular dielectric material, on top of the antenna, or by using novel feeding arrangements by cross-connecting feeds of different array elements. However, for conventional antenna arrays, such matching techniques do not generally work for all other ϕ planes of scanning The array's input impedance for a conventional design, unlike exemplary antenna arrays consistent with the present invention, is different in different ϕ planes. Therefore, in such conventional designs, the variable impedance in different ϕ planes of scanning would no longer match as well to a given source impedance (which is originally designed to match to the array impedance at a given ϕ plane). This problem is clearly overcome by antenna arrays consistent with the present invention. If the new antenna element is used, any conventional matching technique designed for one $\phi$ plane would work perfectly well for all other $\phi$ values of scan direction. This is because, as demonstrated above, in antenna arrays consistent with the present invention, input impedance is independent of the $\phi$ angle of scanning. This significantly simplifies the design of antenna arrays for scanning in three dimensions, §4.4 Refinements, Extensions and Alternatives Referring back to the power coupling modules 125 of FIG. 1, the equivalent impedance, $Z_{in}=R_{in}+jX_{in}$, seen at the input of each element 110/210 of an antenna array is in general dependent on both the angles $\theta$ and $\phi$, along which the array is to be steered. As the array is electronically steered by changing the phase of the input signals to the elements (e.g., by controller 130), the mutual interaction between all the antenna elements 110 changes with the signal phase, resulting in a variable input impedance with the angle of steering.

$$Z_{in}(\theta,\phi)=R_{in}(\theta,\phi)+jX_{in}(\theta,\phi) \tag{5}$$

For an ideal periodic array with an infinite number of elements, the input impedance would be equal for each antenna element. This is because the infinite periodic environment would look the same to each antenna element. However, in a finite-sized array 700, the antenna elements 110/210 placed towards the edge of the array 700 would see a somewhat different environment, as compared to an antenna element 110/210 in the center of the array 700. This would result in the input impedance of the edge elements deviating from that of the center elements. It may be assumed that such deviations from element to element are practically small.

As the antenna array is electronically steered in a different direction, the signal source at the input of each antenna element 110/210 would see a varying load impedance. Accordingly, the matching condition seen by each input source would change with the steering angle. Therefore, if the source was matched for optimum power radiation at a particular direction of scanning, the matching condition would become invalid as the array is steered to a different direction. Thus, the matching might have to be circuit tuned again for the new direction of scanning However, in a conventional array design, where the input impedance is a general function of the angles, the array has to be re-matched at a large number of scanning directions, requiring prohibitively complex circuitry in terms of space or cost of fabrication. This is probably the most critical issue faced in the design of scanning antennas today, which limits common designs to scanning over only a limited angular space.

The planar dipole antenna of FIGS. 4 and 5 is a special radiating element, which produces (near) ideal, isotropic radiation in all directions. The impedance behavior of the particular antenna element 210 when used in a large-array environment 700 is considered. In such an environment, particularly when the antenna length is sufficiently small compared to wavelength, and the array elements are spaced less than a half-wavelength apart, the antenna input impedance $Z_{in}$ is found to have the following special behavior. The reactance part $X_{in}$ is independent of the scan angles $(\theta,\phi)$, when the antenna element 110/210 separation ideally approaches zero. Fortunately, however, there is only minimal variation of the reactance part $X_{in}$ as a function of the scan angles $(\theta,\phi)$ when the antenna elements 110/210 are separated up to a half-wavelength.

The real part $R_{in}$ of the input impedance $Z_{in}$ is independent of the azimuth angle $\phi$ and is a function of only the elevation angle $\theta$. Therefore, such antenna impedance characteristics, together with the antenna's isotropic radiation, can be strategically utilized for a novel array design.

$$R_{in}(\theta,\phi)=R_{in}(\theta),\ X_{in}(\theta,\phi)\approx X_{in},\ Z_{in}(\theta,\phi)=R_{in}(\theta)+jX_{in} \tag{6}$$

Thus, an antenna array 700 consistent with the present invention can radiate in all directions, and can therefore "see" in all directions without any "blind" angles. In addition, its input impedance can be conveniently matched to the input source as described in the following, allowing maximum power delivered in any given direction when the array is used as a transmitter, or maximum power extracted from any given direction when used as a receiver.

Figure 8:
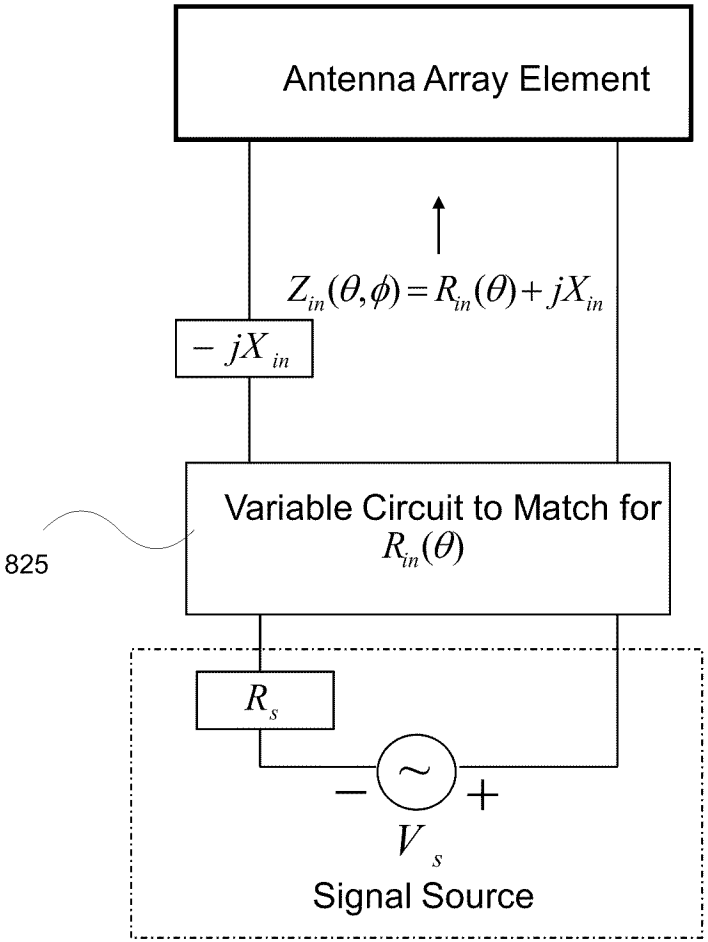
FIG. 8 illustrates a variable matching circuit for an antenna array with input impedance $R_{in}(\theta)$.

Therefore, as illustrated in FIG. 8, a variable matching circuit 825 maybe designed, which can now be conveniently adjusted only for the elevation scan angle $0°<\theta<90°$. Referring back to FIG. 1, such a variable matching circuit may be provided in (or as) the power coupling modules 125.

The above discussed ideal performance assumes that the dipole element is electrically small, with a source transform which is constant over all wave numbers or spatial directions. In this case, the radiation pattern would be ideally determined only by the impedance characteristics of the substrate elements. In practical situations, when the dipole element has a non-zero length, there would be some deviations from the ideal isotropic nature of the radiation power pattern. If the dipole is designed, with its length which is a reasonably small fraction of the wavelength, the resulting radiation pattern would be practically close to an isotropic pattern.

With the foregoing in mind, one skilled in the art can design matching circuits for various antenna arrays consistent with the present invention. Matching circuits are discussed in the text *Microwave Engineering*, by David Pozar (Addision Wesley, ISBN 0-201-50418-9)(incorporated herein by reference).

Referring back to FIGS. 4 and 5, the substrate elements 420*a/b* may include conducting rods or wires 430. The rods or wires may be formed from good conductors such as copper, gold, etc. However, the substrate elements 420*a/b* might be implemented using a modern polymer technology, in which case the reinforcing metal wires or rods might be replaced by aligning conducting polymers. Using such conducting polymers provides the potential for a lower-cost manufacturing of the antenna device.

Referring back to FIG. 7, antenna elements 210 may be strip radiators (L×W), with a delta-gap voltage source. The elements 730 may be metal posts or wires (e.g., with a radius=c of the order of one-hundredth of wavelength, and periodicity a×a of similar order. A periodicity using a separation of about twice the diameter of the post or wire is considered to be a dense distribution. Although a larger separation would cause a deviation from ideal performance, such larger separations should still provide good results. Indeed, performance should not drastically suffer unless the periodicity uses a significantly larger separation—on the order of 0.1 wavelength or more.).

§4.5 Exemplary Methods

Figure 9:
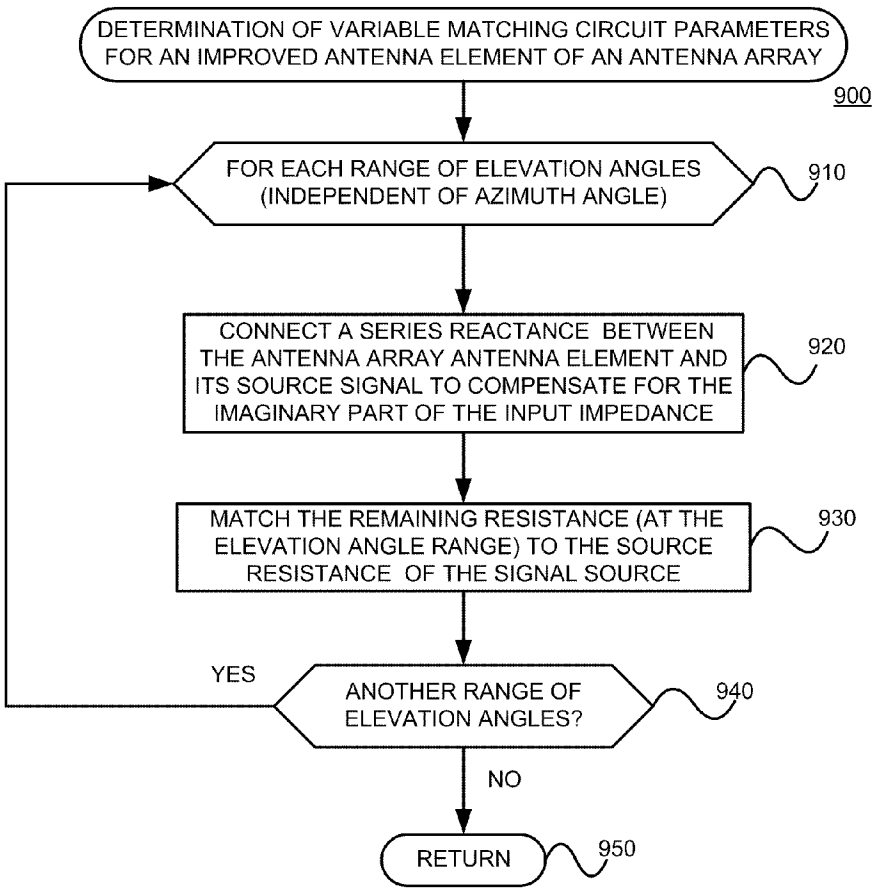
FIG. 9 is a flow diagram of an exemplary method 900 for determining variable matching circuit parameters for an improved antenna element of an antenna array consistent with the present invention.

FIG. 9 is a flow diagram of an exemplary method 900 for determining variable matching circuit parameters for an improved antenna element of an antenna array consistent with the present invention. For each of a plurality of ranges of elevation angles, certain acts are performed. (See loop 910-940.) More specifically, a series reactance (which is negative $X_{in}$) is connected between the antenna array element and its signal source. (Block 920) The remaining resistance (at the elevation angle range) is then matched to the source resistance of the signal source. (Block 930). When all of the plurality of ranges of elevation angles have been processed, the method is left. (Node 950)

Referring back to loop 910-940, for certain tasks, it might not be necessary to process all ranges of elevation angels. For example, if a radar needs to steer to a given range of angles (at a particular time), the design parameters for the particular range would then be selected. So the method 900 could check the radiation/reception direction, and determine a design(s) applicable for the particular range.

The method 900 may be performed for each antenna element of the antenna array.

In some embodiments consistent with the present invention, it may be assumed that the resistance varies monotonically with the inverse of the cosine of the elevation angle (θ).

Note that method 900 may operate without consideration of the azimuth angle (Φ).

Referring back to loop 910-940, the entire range of elevation angles may be divided into a finite number of segments N, depending on the performance accuracy desired. Consequently, the variable matching circuit would need only N sets of variables to work for the different segments corresponding to different ranges of elevation angles. Only a handful of elevation segments N might be sufficient to cover the entire space with acceptable performance.

Further, the resistance $R_{in}$ (θ) varies monotonically with the inverse of cos θ. Such orderly, monotonic variation of impedance with scan angle θ is also a special characteristic, distinct from other conventional planar antennas. This feature can be used to simplify matching design or tuning arrangement.

As should be appreciated from the foregoing, the imaginary part of the input impedance may be compensated by connecting a series reactance (which is negative $X_{in}$). The remaining resistance $R_{in}(\theta)$ is then matched to the source resistance $R_s$ of the signal source, using a suitable matching circuit. Since the input resistance is independent of the azimuth angle ϕ, any matching circuit which works for a given ϕ, would work equally well for all ϕ. Therefore, as illustrated in FIG. 8, a variable matching circuit 825 maybe designed, which can now be conveniently adjusted only for the elevation scan angle $0° < \theta < 90°$. Referring back to FIG. 1, such a variable matching circuit may be provided in (or as) the power coupling modules 125.

As mentioned, the above special characteristics would not have been possible for array designs using conventional antenna elements. Therefore, the new array design would provide significant performance improvement over conventional arrays, allowing development of much advanced wireless communication or radar systems.

§4.6 Conclusions

As should be appreciated from the foregoing, embodiments consistent with the present invention permit electronic beam scanning (also referred to as "steering") while permitting performance of power coupling from signal sources at the antenna inputs to be optimized in a manner which is independent of the azimuth (Φ) scanning direction (dependent only on one spatial variable (elevation angle, θ) of scanning).

What is claimed is:

1. A system comprising:

a) an array of dipole antenna elements;

b) a control circuit for steering the dipole antenna elements over a first range of elevation angles and a second range of azimuth angles;

c) at least one wired substrate arranged adjacent to the array of dipole antenna elements such that each of the dipole antenna elements has a substantially isotropic radiation characteristic; and d) for each of the dipole antenna elements of the array, a power coupling module adapted to match a resistance of the dipole antenna element to a source resistance of a signal source, as a function of a current elevation angle, but independent of a current azimuth angle, wherein the at least one wired substrate has a height h and is spaced from the array of dipole antenna elements with a spacing s which is much less than the height h, and wherein the height h of the at least one wired substrate is approximately one quarter of a free-space wavelength of radiation provided by the array of dipole elements.

2. The system of claim 1 wherein the at least one wired substrate is made from wires arranged in a polymer-based foam.

3. The system of claim 1 wherein the at least one wired substrate portion has a dielectric constant on the order of 1.

4. The system of claim 1 wherein the at least one wired substrate includes two wired substrates, one on each side of the array of antenna elements.

5. The system of claim 1 wherein the at least one wired substrate includes a plurality of copper wires.

6. The system of claim 1 wherein the at least one wired substrate includes a plurality of gold wires.

7. The system of claim 1 wherein the at least one wired substrate includes a plurality of aligned conducting polymers.

8. The system of claim 1 wherein the at least one wired substrate operates as a quarter-wave transformer.

9. The system of claim 1 wherein the dipole antenna elements of the array are separated by up to a half wavelength of radiation provided by the array of dipole antenna elements.

10. The system of claim 1 wherein the at least one wired substrate includes posts or wires, each having a radius of the order of one-hundredth of the wavelength of radiation provided by the array of dipole antenna elements.

11. The system of claim 1 wherein the at least one wired substrate includes posts or wires are arranged in an array with periodicity of the order of one-hundredth of the wavelength of radiation provided by the array of dipole antenna elements.

12. The system of claim 1 wherein the at least one wired substrate includes posts or wires separated from one another by about twice a diameter of the post or wire.

13. The system of claim 1 wherein each of the at least one wired substrate includes vertically arranged, substantially linear, wires.

14. A method for determining variable matching circuit parameters for an improved antenna element of an antenna array, the method comprising, for each of a plurality of ranges of elevation angles:

a) providing a series reactance between the antenna array element and its signal source, wherein the antenna array element is a dipole antenna element and wherein the antenna array is arranged adjacent to at least one wired substrate such that each of the dipole antenna elements of the antenna array has a substantially isotropic radiation characteristic; and b) matching a remaining resistance, at the elevation angle range, to the source resistance of the signal source, wherein the remaining resistance is independent of an azimuth angle, wherein the at least one wired substrate has a height h and is spaced from the antenna array with a spacing s which is much less than the height h, and wherein the height h of the at least one wired substrate is approximately one quarter of a free-space wavelength of radiation provided by the antenna array.

15. The method of claim 14 wherein each of the at least one wired substrate includes vertically arranged, substantially linear, wires.

* * * * *